US010632632B1

(12) United States Patent
Demko

(10) Patent No.: US 10,632,632 B1
(45) Date of Patent: Apr. 28, 2020

(54) ARM BLADE ENGAGEMENT LOCK FOR FOLDING KNIFE

(71) Applicant: Andrew Demko, Wampum, PA (US)

(72) Inventor: Andrew Demko, Wampum, PA (US)

( * ) Notice: Subject to any disclaimer, the term of this patent is extended or adjusted under 35 U.S.C. 154(b) by 0 days.

(21) Appl. No.: 16/356,157

(22) Filed: Mar. 18, 2019

(51) Int. Cl.
*B26B 1/04* (2006.01)

(52) U.S. Cl.
CPC ..... *B26B 1/048* (2013.01)

(58) Field of Classification Search
CPC ..... B26B 1/048
USPC ..... 30/160, 161
See application file for complete search history.

(56) References Cited

U.S. PATENT DOCUMENTS 1,614,949 A * 1/1927 Finley ..... B26B 23/00 30/308.2
2,188,762 A * 1/1940 Schrade ..... B26B 1/046 30/160
2,263,415 A * 11/1941 Schaaff ..... B26B 1/042 30/160
4,451,982 A * 6/1984 Collins ..... B26B 1/048 30/157
4,837,932 A 6/1989 Elsener
5,737,841 A * 4/1998 McHenry ..... B26B 1/048 30/160
6,079,106 A * 6/2000 Vallotton ..... B26B 1/048 30/155
6,574,869 B1 * 6/2003 McHenry ..... B26B 1/048 30/160
6,591,504 B2 7/2003 Onion
7,469,476 B2 * 12/2008 Demko ..... B26B 1/042 30/160
7,506,446 B2 * 3/2009 Onion ..... B26B 1/048 30/160
7,698,821 B2 * 4/2010 Ralph ..... B26B 1/048 30/158
7,941,927 B1 * 5/2011 Demko ..... B26B 1/048 30/157
8,458,913 B2 * 6/2013 Lo ..... B26B 1/044 30/159
8,745,878 B2 * 6/2014 Glesser ..... B26B 1/048 30/155
9,975,259 B2 * 5/2018 Liu ..... B26B 1/048
2007/0169354 A1 * 7/2007 Ralph ..... B26B 1/046 30/160
2010/0192381 A1 * 8/2010 Sakai ..... B26B 1/048 30/160
2012/0291291 A1 * 11/2012 Lo ..... B26B 1/044 30/161
2013/0160300 A1 * 6/2013 Liu ..... B26B 1/048 30/159
2013/0291389 A1 * 11/2013 Chen ..... B26B 1/048 30/160

(Continued)

*Primary Examiner* — Kenneth E Peterson
(74) *Attorney, Agent, or Firm* — Harpman & Harpman

(57) ABSTRACT

A folding knife having a blade pivoted from a closed position to an open locked position with a combined self-activating sliding release and locking arm. The sliding locking arm is mounted within the knife handle on dual fixed guide and pivot pins within respective arm openings being spring urged there against. Arm projections are engaged by the blade shank during operation moving the locking arm back and up then releasing to slide forward locking the blade in open use position until manual arm engagement by the user against the spring for release and transitional closure.

3 Claims, 4 Drawing Sheets

(56) References Cited

U.S. PATENT DOCUMENTS

2015/0239134 A1* 8/2015 Duey ..... B26B 1/046
30/159
2016/0354936 A1* 12/2016 Busse ..... B26B 1/048

* cited by examiner

ARM BLADE ENGAGEMENT LOCK FOR FOLDING KNIFE

BACKGROUND OF THE INVENTION

1. Technical Field

This invention relates to folding pocket type knives that have locking mechanisms to hold the knife blade in open locked use position or in folded closed non-use position. Such locking mechanisms are referred to as locking bars or pin configurations.

2. Description of Prior Art

Prior art folding knives have been developed with a variety of blade locking engagement structures to afford numerous blade lock and release positions, see for example U.S. Pat. Nos. 4,837,932, 6,574,869 and 6,591,504.

In U.S. Pat. No. 4,837,932, a locking blade pocket knife is disclosed having a beam spring with a retractable locking member with a ratchet tooth, cam guide and engaging the tang portion of the knife blade controlling movement.

U.S. Pat. No. 6,547,869 claims a folding pocket knife with a lock having a sliding lock element with a pin projection that engages the blade preventing unlocking from the open position unintentionally.

U.S. Pat. No. 6,591,504 shows a folding knife with a safety lock movably mounted on its handle for a lock to unlock position.

SUMMARY OF THE INVENTION

A folding knife locking device having a spring urged self-repositioning safety lock arm that is engaged by the blade shank as it opens being repositioned thereby in longitudinal and pivotal travel paths. User arm initiation is required to unlock from open position releasing the spring urged slidable dual action self-locking arm. Multiple arm to blade shank engagement points define blade open lock position and corresponding blade retainment in closed position with continuous intermediate positioning.

DETAILED DESCRIPTION OF THE INVENTION

Figure 1:
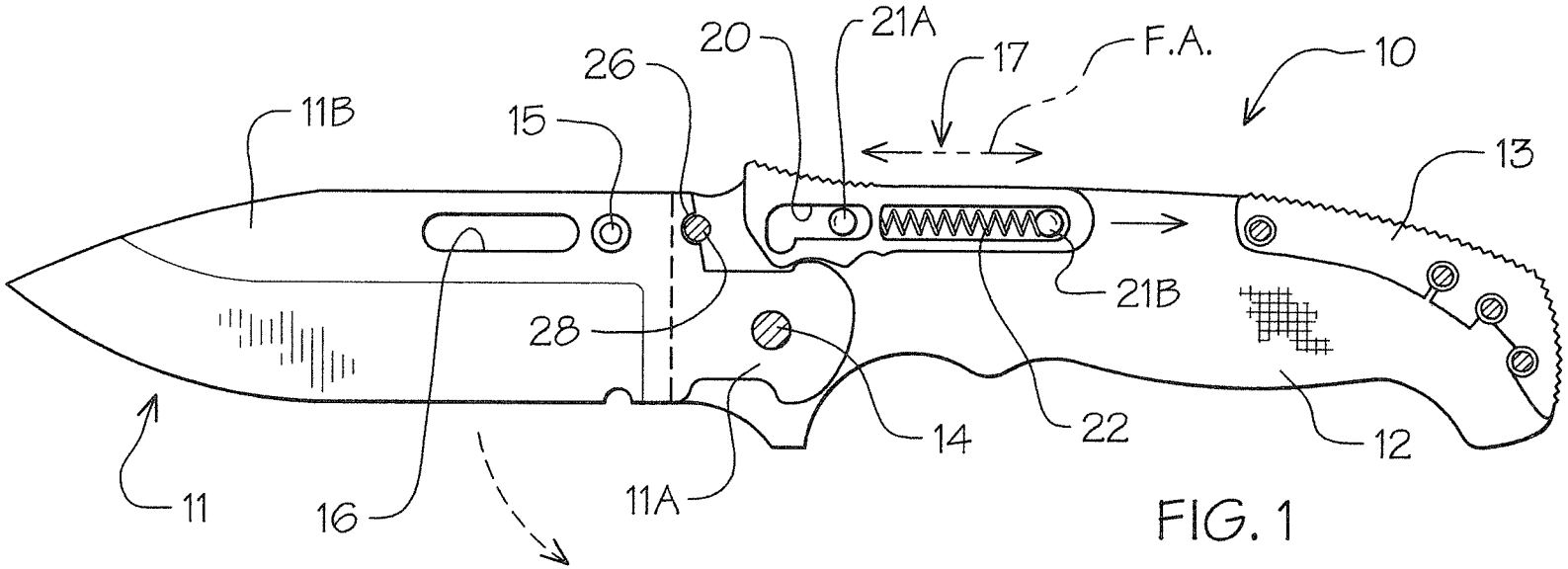
FIG. 1 is a side elevational view of a folding knife of the invention in open locked position with portions broken away.
Figure 2:
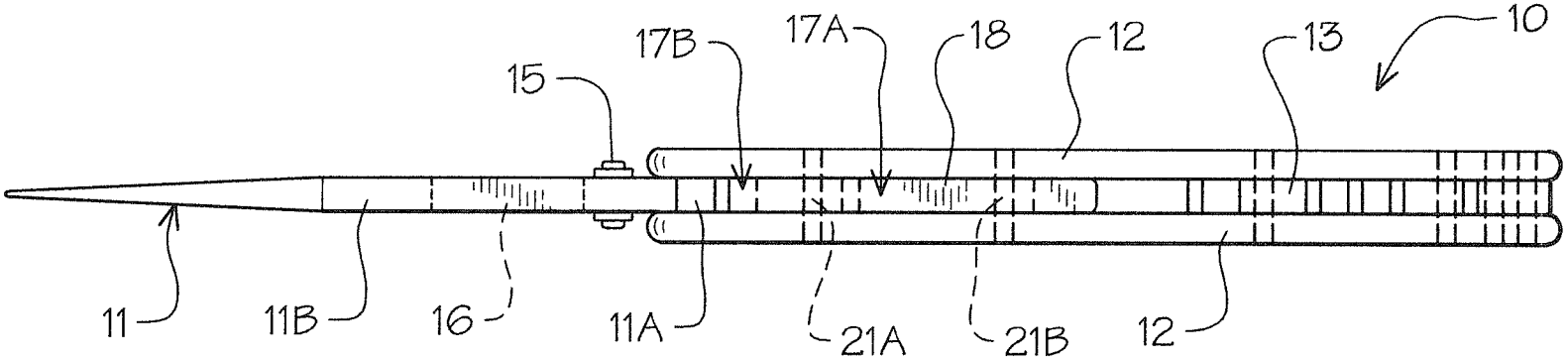
FIG. 2 is a top plan view of the folding knife.
Figure 3:
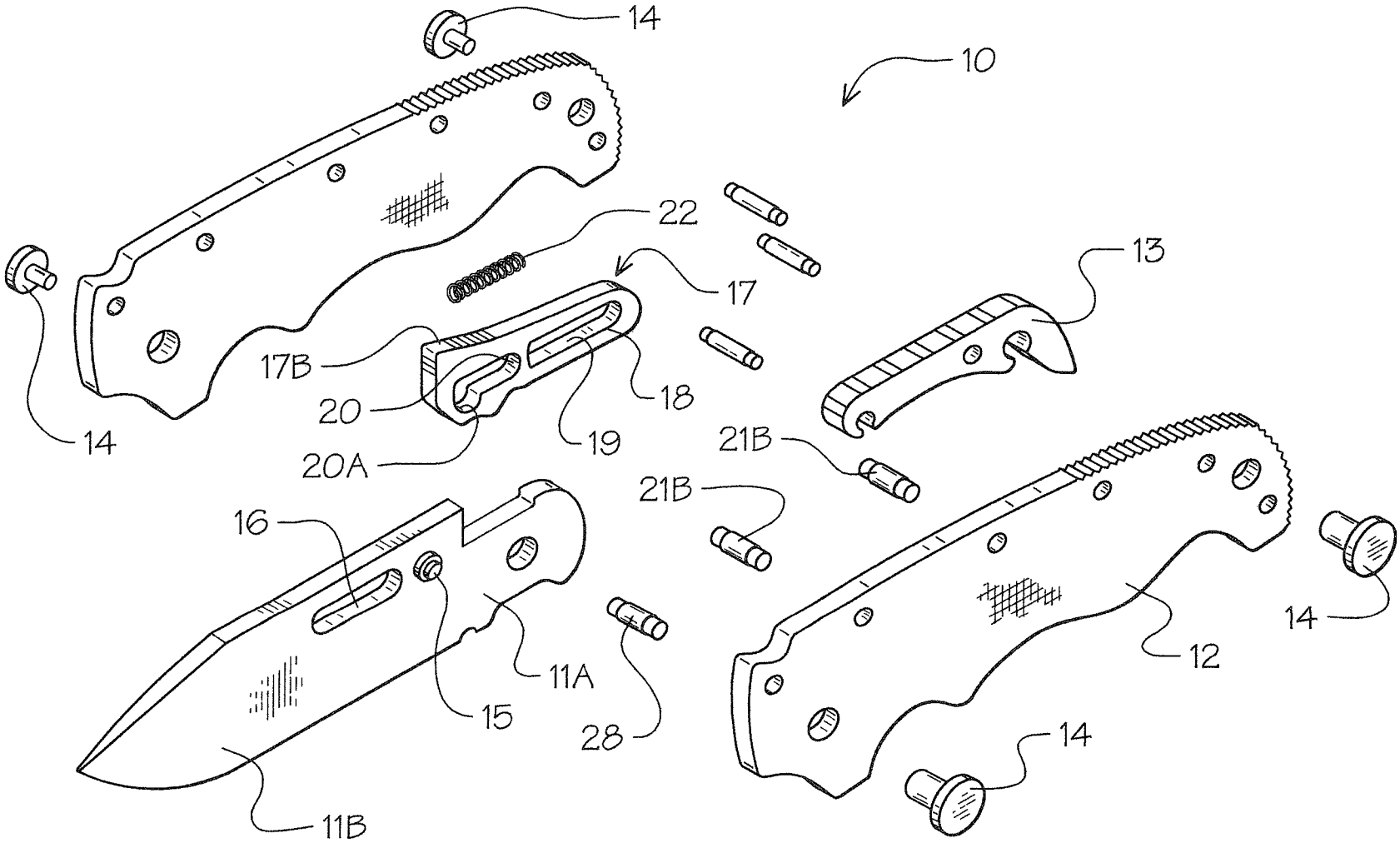
FIG. 3 is an exploded perspective assembly view of the folding knife of the invention in open position.

Referring to FIGS. 1 and 2 of the drawings, a folding knife 10 of the invention can be seen in its unfolded locked position. The knife 10 has a blade 11 pivotally secured within handle portions 12 with an end handle support spacer 13 secured there between. The blade 11 is pivotally secured between handle portions 12 by a hinge pin fitting 14 therethrough for manual displacement which defines a folding knife configuration. The blade 11 has a shank 11A with an extending blade body 11B and a thumb engagement stud 15 with an elongated user access slot 16 within the blade body for ease of deployment from closed position as seen in FIG. 5 of the drawings.

Figure 4:
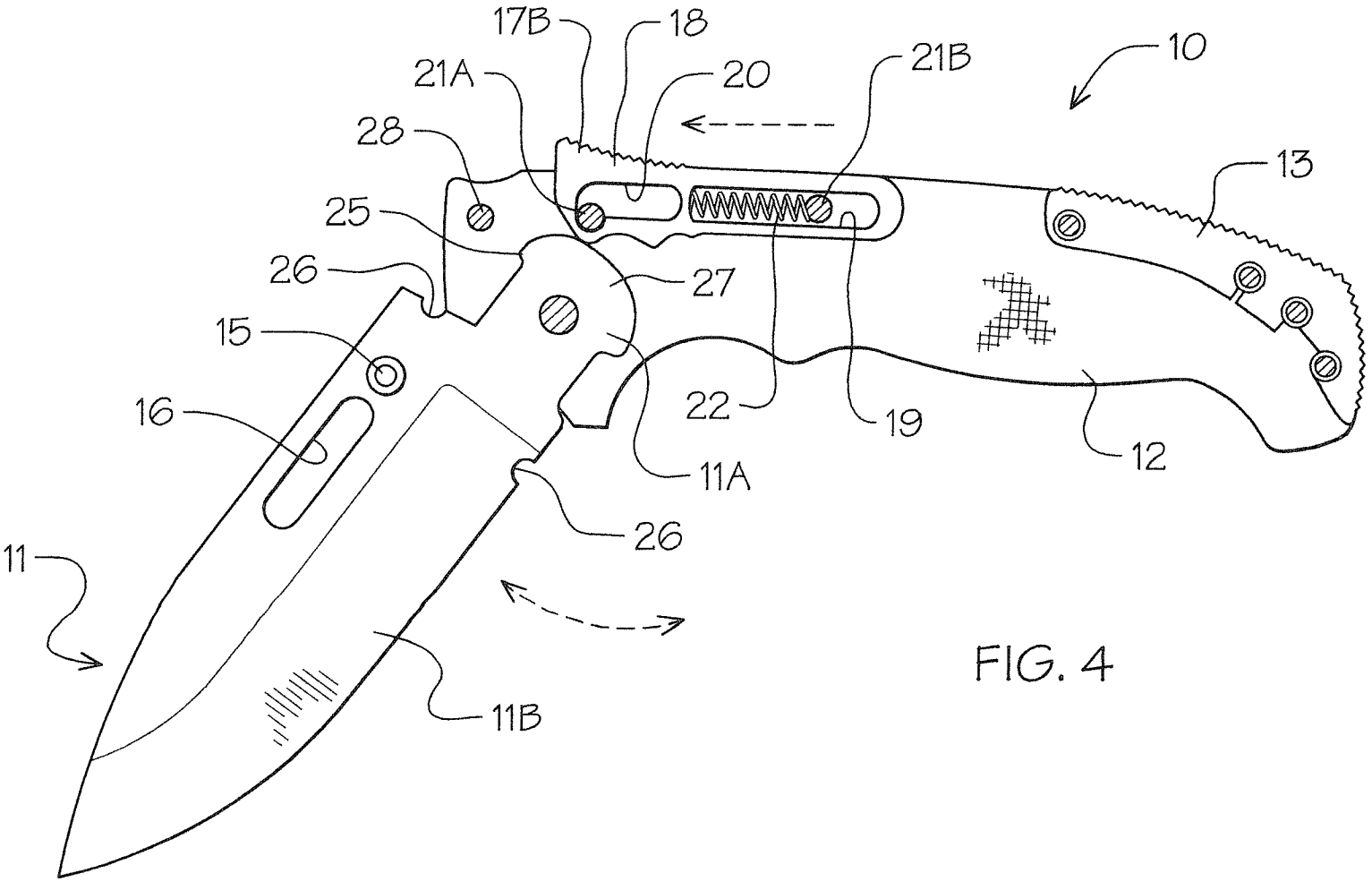
FIG. 4 is a side elevational view with portions broken away of the folding knife with locking arm release in partially opened or closed position.
Figure 5:
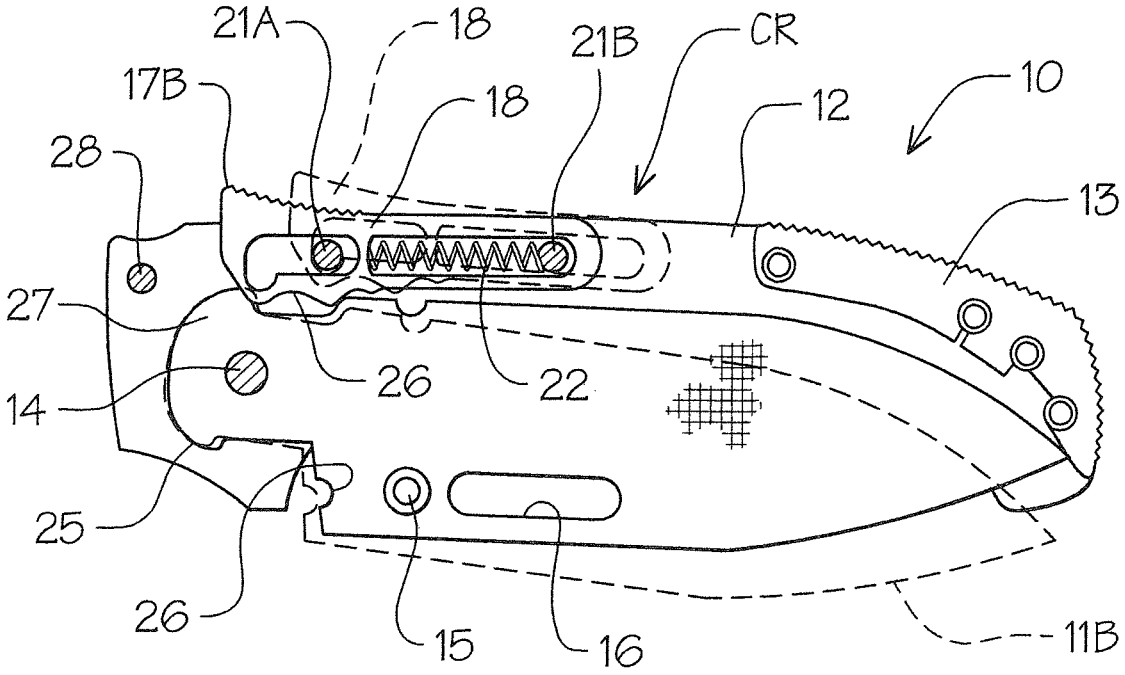
FIG. 5 is an enlarged side elevational view with portions broken away of the folding knife in closed locking arm engaged position.

A safety release locking arm assembly 17 is movably positioned within the handle portions 12 to and from open blade lock position OL and closed blade retainment position CR illustrated in FIGS. 1 and 5 of the drawings. Safety release locking arm assembly 17 has an apertured arm 18 with an elongated repositioning retainment slot 19 therein. A second repositioning guide slot 20 is formed adjacent the slot 19 having a foreshortened length with a contoured depending end portion at 20A, best seen in FIGS. 1, 3-6 of the drawings.

The safety release locking arm assembly 17 is, as noted, movably retained within and between the handle portions 12 by a pair of fixed guide pins 21A and 21B. Guide pin 21A is received within the arm slot 20 while the guide pin 21 extends through the corresponding arm slot 19.

A resilient spring 22 is retained within the slot 19 thus urging the locking release arm 18 towards the blade shank 11A for selective constant engagement therewith during the blade range of motion as will be described in detail hereinafter.

The arm's upper surface 17A has an upstanding tapered and textured end portion surfaces 17B over the contoured slot 19 which acts as and extends from the handle portions 12 for a user engagement surface during use.

Figure 6:
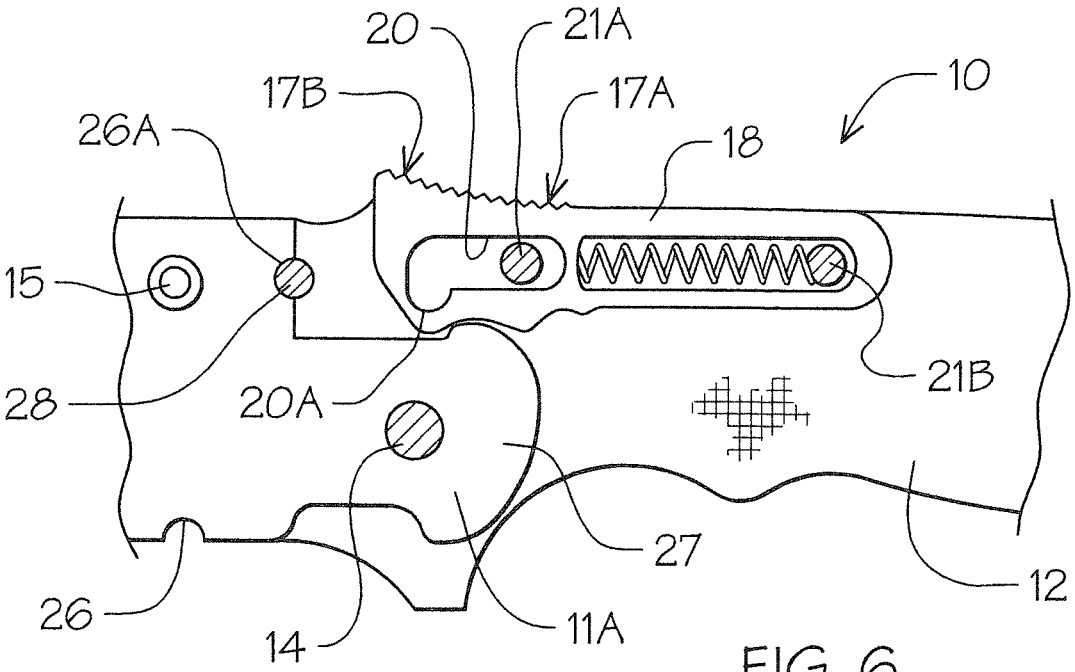
FIG. 6 is an enlarged partial side elevational view of the locking arm engaging in locked open position with portions broken away.

The lower end surface 17C in oppositely disposed relation thereto has tapered blade shank engagement portion 23 which defines the depending portion of the arm 18 for direct retainment engagement with an upstanding locking tab 25 on the blade shank 11A in blade open lock position, as best seen in FIG. 6 of the drawings. A tapered end arm surface 26 extends from the lower arm surface engagement portion 23 and correspondingly will be in direct blade shank engagement when in closed position as seen clearly in FIG. 5 of the drawings against a shank retainment tab 27 formed by the arcuate end surface of the blade shank 11A.

A stop pin 28 is provided and extends from the handles 12 for registration with a notch 26A in the blade shank 11A assuring blade travel limit for proper blade shank locking tab 25 with locking release arm 18 engagement as hereinbefore described.

It will therefore be seen that in use from a closed folded position shown in FIG. 5 of the drawings, the blade 11 is held in place within the handles 12 by the spring urged locking retainment activation arm 18 engaged against the blade shank retainment tab 27. Upon user, not shown, blade engagement via the thumb engagement stud 15 and indirectly the user access slot 16, the blade 11 can be pivoted outwardly sliding the locking release arm 18 back against the relevant spring 22 as shown in broken lines in FIG. 5 of the drawings. As the shank tab 11A rotates, it will simultaneously lift the arm 18 which is accomplished due to the contoured depending portion of the increased dimension of the slot 19 as seen in FIG. 4 of the drawings as the end surface of the arm 18 travels along the radial end of the shank 11A.

Once the blade 11 reaches full open position as illustrated best in FIGS. 1 and 6 of the drawings, the locking arm 18 slides back under spring 22 tension and locks the blade in open position. The arm's tapered blade shank engagement portion 23 is engaged as described on the shank's upstanding locking tab 25. Correspondingly, to close the knife the user, not shown, will engage the locking arm's 18 upper end surface 17B sliding it back against the spring tension, releasing the blade 11 illustrated by force arrows FA thus releasing the blade shank 11A and the blade 11 allowing it to be pivoted down into the closed position in FIG. 5 of the drawings.

It will therefore be apparent from the above described operational action that the folding knife 10 with the safety release locking arm assembly 17 achieves multiple actionable locking arm to blade and blade shank positional engagement in a continuous controlled contact and locking engagement positions to define a unique safety lock arm assembly for a folding knife.

It will thus be seen that a new and useful folding arm locking knife has been illustrated and described and it will be apparent to those skilled in the art that various changes can be made therein without departing from the spirit of the invention.

Therefore, I claim:

1. A folding knife comprises, an elongated handle, an elongated knife blade having a sharp edge portion and a contoured shank portion, said knife blade coupled within said handle for pivoted movement from a first closed retained position to a second open locked position, a locking arm within said handle for spring-urged continuous engagement with said contoured shank portion from said first closed retained position to said second open lock position, said locking arm having a linear guide slot, an L-shaped guide slot, and a tapered upstanding end portion surface, said handle having a first guide pin engaging said linear guide slot, and a second guide pin engaging said L-shaped guide slot, said locking arm having longitudinal motion when said second guide pin engages a first leg of said L-shaped guide slot, said locking arm having vertical motion perpendicular to said longitudinal motion when said second guide peg engages a second leg of said L-shaped guide slot to allow said knife blade to pivot, a blade shank engagement portion depending from said locking arm, and a locking tab on said blade shank for registration with said blade shank engagement portion in the open locked position.

2. The folding knife set forth in claim 1 wherein said elongate handle has handle portions that have an end handle spacer there between.

3. The folding knife set forth in claim 1 wherein said blade shank portion has an arcuate end surface defining a shank retainment tab that engages said locking arm when said knife blade is in the closed position.

* * * * *